US007229262B2

(12) United States Patent
Patterson

(10) Patent No.: US 7,229,262 B2
(45) Date of Patent: Jun. 12, 2007

(54) ROTARY PISTON PUMP END PRESSURE REGULATION SYSTEM

(75) Inventor: Albert W. Patterson, West Lorne (CA)

(73) Assignee: 1564330 Ontario Inc., Ontario (CA)

( * ) Notice: Subject to any disclaimer, the term of this patent is extended or adjusted under 35 U.S.C. 154(b) by 75 days.

(21) Appl. No.: 11/226,225

(22) Filed: Sep. 15, 2005

(65) Prior Publication Data

US 2007/0059195 A1 Mar. 15, 2007

(51) Int. Cl.
*F03C 2/00* (2006.01)

(52) U.S. Cl. ..... 418/133; 418/132; 418/127; 418/259; 418/266; 123/264

(58) Field of Classification Search ..... 418/132, 418/133, 104, 127, 146, 147, 259, 266; 123/264
See application file for complete search history.

(56) References Cited

U.S. PATENT DOCUMENTS 3,057,304 A * 10/1962 Rohde ..... 418/133
3,640,648 A * 2/1972 Odawara ..... 418/133
3,694,114 A * 9/1972 Eickmann ..... 418/82
3,727,589 A * 4/1973 Scott ..... 418/260
4,408,964 A * 10/1983 Mochizuki et al. ..... 417/310
4,416,598 A * 11/1983 Merz ..... 418/132
4,484,863 A * 11/1984 Pagel ..... 417/204
4,917,584 A 4/1990 Sakamaki et al.
6,030,195 A * 2/2000 Pingston ..... 418/82
6,554,596 B1 4/2003 Patterson et al.
6,899,528 B2 * 5/2005 Youngpeter et al. ..... 417/310
6,945,218 B2 9/2005 Patterson

FOREIGN PATENT DOCUMENTS

JP 57-32095 2/1982

* cited by examiner

*Primary Examiner*—Thomas Denion
*Assistant Examiner*—Mary A. Davis
(74) *Attorney, Agent, or Firm*—Nixon Peabody LLP; Jeffrey L. Costellia

(57) ABSTRACT

A rotary piston pump for fluids, wherein the ends of the housing are configured so as to provide reduced pressure differentials between opposite sides of the rotor end disks.

8 Claims, 6 Drawing Sheets

ROTARY PISTON PUMP END PRESSURE REGULATION SYSTEM

FIELD OF THE INVENTION

The present invention relates to pump end pressure regulation systems for use in rotary piston pumps.

BACKGROUND OF THE INVENTION

Rotary pistons pumps, in the nature of encased rotors with rotor disks at the rotor ends and vanes between those rotor disks, which vanes move radially in and out of the rotors depending upon their location within the casing, are known.

One such device is described in U.S. Pat. No. 6,554,596 of Albert and David Patterson, issued Apr. 29, 2003, in which the vane movement, in and out of the rotor, is achieved by cam surfaces within the casing, which surfaces act on both inner and outer edges of the vanes.

In applicant's co-pending U.S. patent application Ser. No. 10/680,236 entitled rotary pistons, the outward movement of the vanes is achieved by upward extensions of shoulders at the sides of each vane, which upward extensions contain pins which are seated in races continuously extending in portions of the interior side wall of the casing and positioned so that as the pins move about the races, they draw their respective vanes outwardly and inwardly.

Other known constructions of such rotary pistons require centrifugal force, through rotation of the rotor, to force the vanes outwardly. For instance, in applicant's U.S. Pat. No. 6,896,502, issued May 24, 2005, three planar vanes are seated in rotor slots formed along chords, when the cylindrical rotor is viewed in lateral cross-section, those slots being oriented so that the planes of adjacent vanes lie at 60° angles to each other.

In applicant's co-pending U.S. patent application Ser. No. 10/680,236, filed Oct. 8, 2003, outward movement and maintenance of the outward positioning of the vanes is assisted by biasing means, for example springs.

Such rotary piston pumps are constructed to move fluids at relatively high pressure. Those portions of the rotor disks as they pass in the vicinity of the pump intake port, are under significantly lower pressure than those portions which are upstream from the outlet port, which are often under significantly higher pressure. When operating under such high pressure conditions, this pressure differential may cause the rotor disks to distort, significantly affecting the efficiency of operation of the pump and reducing the usable lifespan of pump components such as the rotor disks.

It is an object of the present invention to provide a rotary piston pump that reduces the pressure differentials acting on the rotor disks. It is a further object, of one embodiment of the present invention, to provide a rotary piston pump that uses fluid pressure within the pump to assist in movement of the vanes.

SUMMARY OF THE INVENTION

In accordance with the present invention there is provided a rotary piston pump comprising a shaft to rotate about a longitudinal axis. A rotor is centrally secured to the shaft, the rotor having a body with a cylindrical surface extending between spaced ends. A rotor disk is secured at each end of the rotor and each rotor disk is secured at a center to the shaft. A housing encases the rotor and the rotor disks and portions of the shaft within an internal cavity. The housing has interior end walls adjacent to, but spaced from, the corresponding rotor disks to form an end space therebetween, and an interior sidewall, with fluid inlet and fluid outlet ports in the interior sidewall. A first portion of the interior sidewall of the housing is cylindrical and curved with a constant radius over an angle of about approximately 180°. The first portion is spaced a constant distance from confronting portions of the cylindrical surface of the rotor. A second portion of the interior sidewall of the housing extends between the extremities of the first portion of the interior sidewall. The curvature of the second portion has a greater radius than a curvature of the first portion. The cylindrical surface of the rotor is proximal to the interior sidewall of the housing at a point between the fluid inlet and fluid outlet ports about midway along the second portion. The fluid inlet and fluid outlet ports are located in this second portion of the interior sidewall of the housing. Two or more equally spaced, radially oriented slots in the rotor longitudinally extend across the cylindrical surface of the rotor body. Two or more similar vanes are provided, each vane having internal and external edges extending between sides. Each vane is slidably seated in one of said slots, movable radially in the corresponding slot between an extended position with the external edge of the vane adjacent the interior sidewall of the housing, and a retracted position wherein the external edge of the vane does not extend beyond the cylindrical surface of the rotor. The vanes are spaced from adjacent vanes about the rotor such that there is always a vane positioned between the fluid inlet and fluid outlet ports. Means are associated with the vanes to enable the vanes to move to extended position. A plurality of slots in the rotor disks are aligned with the rotor slots and slidably receive the sides of the vanes. The rotor disks, the housing and the vanes are constructed so that, during operation of the rotary piston pump, fluid entering the housing through the inlet port is carried by the rotor, in each of the compartments formed between adjacent vanes, the rotor surface between the vanes, the rotor disks and the corresponding portions of the end walls and interior sidewall of the housing, until the adjacent vanes encompass the outlet port where the fluid is allowed to leave the housing. At least one aperture is provided in each compartment through each rotor disk to permit fluid communication from the compartment to the end space, thereby to permit equalization of fluid pressure in the compartment and in the end space. The end space between each of the corresponding housing end walls and rotor disks are provided with partition sections extending in a line between the fluid inlet and fluid outlet ports and dividing that end space into two sub-sections. The partition sections are constructed so as to withstand pressure differentials between the sub-sections on either side of the partition sections.

In accordance with an alternative embodiment of the present invention there is provided a rotary piston pump comprising a shaft to rotate about a longitudinal axis. A rotor is centrally secured to the shaft, the rotor having a body with a cylindrical surface which extends between spaced ends. A rotor disk is secured at each end of the rotor and each rotor disk is secured at a center to the shaft. A housing encases the rotor and rotor disks and portions of the shaft within an internal cavity, the housing having interior end walls adjacent to the corresponding rotor end disks, and an interior sidewall, with fluid inlet and fluid outlet ports in the interior sidewall. A first portion of the interior sidewall of the housing is cylindrical and curved with a constant radius over an angle of about approximately 180°. The first portion is spaced a constant distance from confronting portions of the cylindrical surface of the rotor. A second portion of the interior sidewall of the housing extends from the extremities of the first portion of the interior sidewall. The curvature of the second portion has a greater radius than the curvature of the first portion. The cylindrical surface of the rotor is proximal to the interior sidewall of the housing at a point between the fluid inlet and fluid outlet ports about midway along the second portion. The fluid inlet and fluid outlet ports are located in the second portion of the interior sidewall of the housing. Two or more equally spaced, radially oriented slots in the rotor longitudinally extend across the cylindrical surface of the rotor body. Two or more similar vanes are provided, each vane having internal and external edges extending between sides. Each vane is slidably seated in one of said slots, movable radially in the corresponding slot between an extended position with the external edge of the vane adjacent the interior sidewall of the housing, and a retracted position is provided wherein the external edge of the vane does not extend beyond the cylindrical surface of the rotor. The vanes are spaced from adjacent vanes about the rotor such that there is always a vane positioned between the fluid inlet and fluid outlet ports. A plurality of slots in the rotor disks are aligned with the rotor slots and slidably receive the sides of the vanes. The rotor disks, the housing and the vanes are constructed so that, during operation of the rotary piston pump, fluid entering the housing through the inlet port is carried by the rotor, in each of the compartments formed between adjacent vanes, the rotor surface between the vanes, the rotor disks and the corresponding portions of the end walls and interior sidewall of the housing, until the adjacent vanes encompass the outlet port where the fluid is allowed to leave the housing. A pair of configured depressions is positioned in each of the end walls, open towards the corresponding rotor disk. Ports at the bottoms of the slots in the rotor disks pass through the rotor disks to provide fluid communication between the lower portions of the rotor disk slots below the vanes and the configured depressions. At least one aperture is provided in each compartment through each rotor disk, the apertures and configured depressions positioned to be intermittently aligned, during operation of the pump, so as to permit equalization of fluid pressure in the compartment and in the configured depressions when the apertures are in alignment with the configured depressions. The configured depressions are configured so as to deliver, during operation of the pump, the lesser pressure of fluid drawn into the compartments from the inlet port through the slots below the vanes as the vanes pass over part of the second portion of the interior sidewall adjacent to the outlet port so as to urge those vanes inwardly towards retracted position, and to deliver the greater pressure of the fluid carried in the compartments between the inlet and outlet ports through the slots below the vanes when the vanes are approaching the inlet port and passing over the constant radius portion of the sidewall, so as to urge those vanes outwardly towards extended position.

The rotary piston pump, in accordance with the present invention, allows fluid pressures within the compartments between the vanes to be replicated on the outside of the rotor disks, between the rotor disks and the ends of the housing, thereby avoiding deflecting or distortion of the rotor disks due to pressure differentials. As well, in one embodiment of the present invention, the pressure differentials existing in the fluids between compartments are used to facilitate the inward and outward movement of the vanes in the rotor vane slots.

BRIEF DESCRIPTION OF THE DRAWINGS

These and other advantages of the invention will become apparent upon reading the following detailed description and upon referring to the drawings in which.

Figure 1:
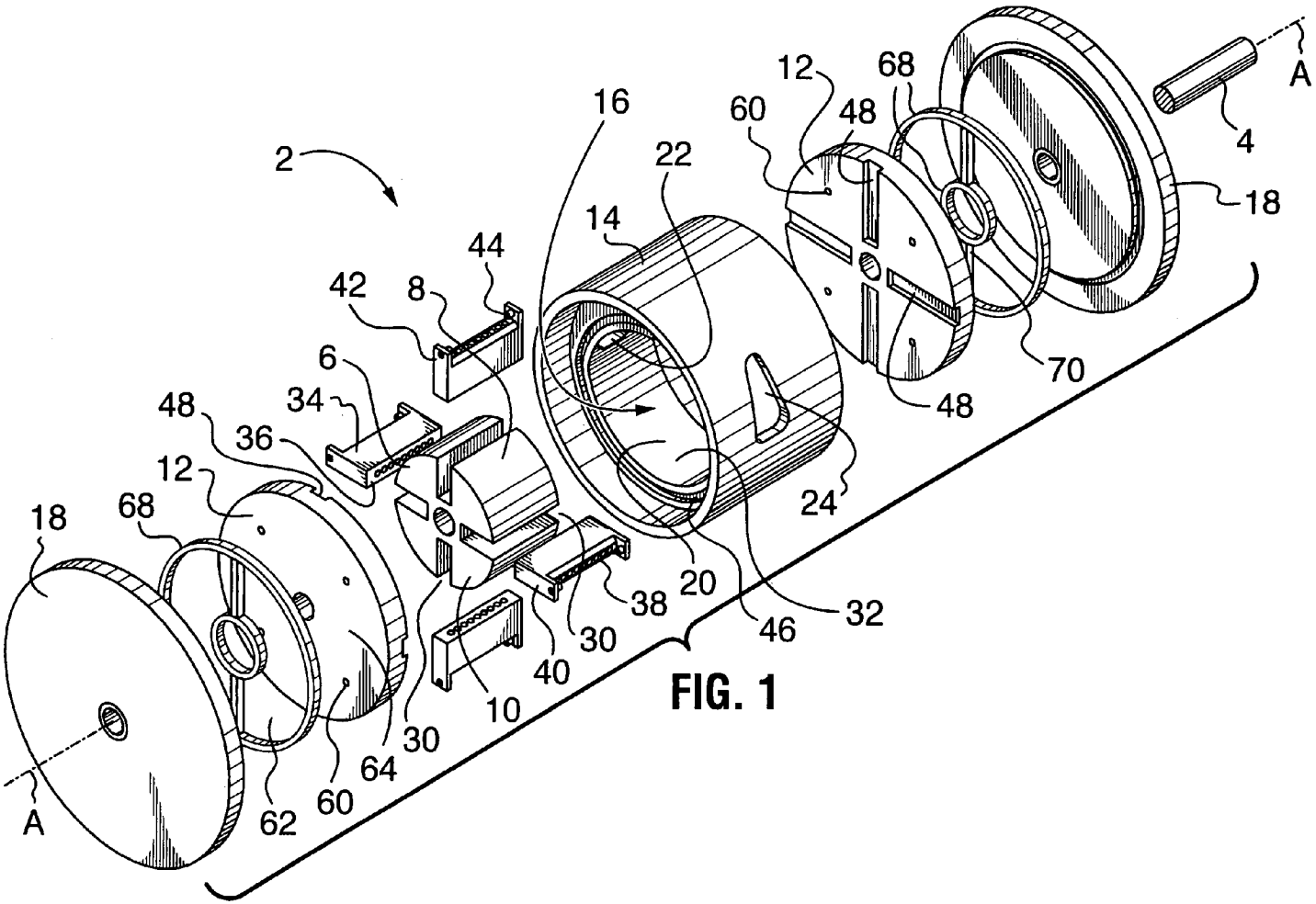
FIG. 1 is an exploded perspective view of an example embodiment of the rotary piston pump according to the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE ILLUSTRATED EMBODIMENTS

In the following description, similar features in the drawings have been given similar reference numerals.

Turning to FIG. 1, there is illustrated a rotary piston pump 2 according to the present invention. Pump 2 comprises a shaft 4 rotating about a longitudinal axis A—A. A rotor 6 is centrally secured to shaft 4. Rotor 6 has a body with a cylindrical surface 8 extending between spaced ends 10. A rotor disk 12 is provided at each end of rotor 6, secured at its center to shaft 4 and to the corresponding end 10 of rotor 6. Shaft 4, rotor 6 and rotor disks 12 may be of integral construction.

A housing 14 encases shaft 4, rotor 6 and rotor disks 12 within an internal cavity 16. Shaft 4 extends outside housing 14, as illustrated. Housing 14 has end walls 18 adjacent to but spaced from rotor disks 12, and an interior sidewall 20. Fluid inlet port 22 and fluid outlet port 24 are provided in interior sidewall 20.

Figure 2:
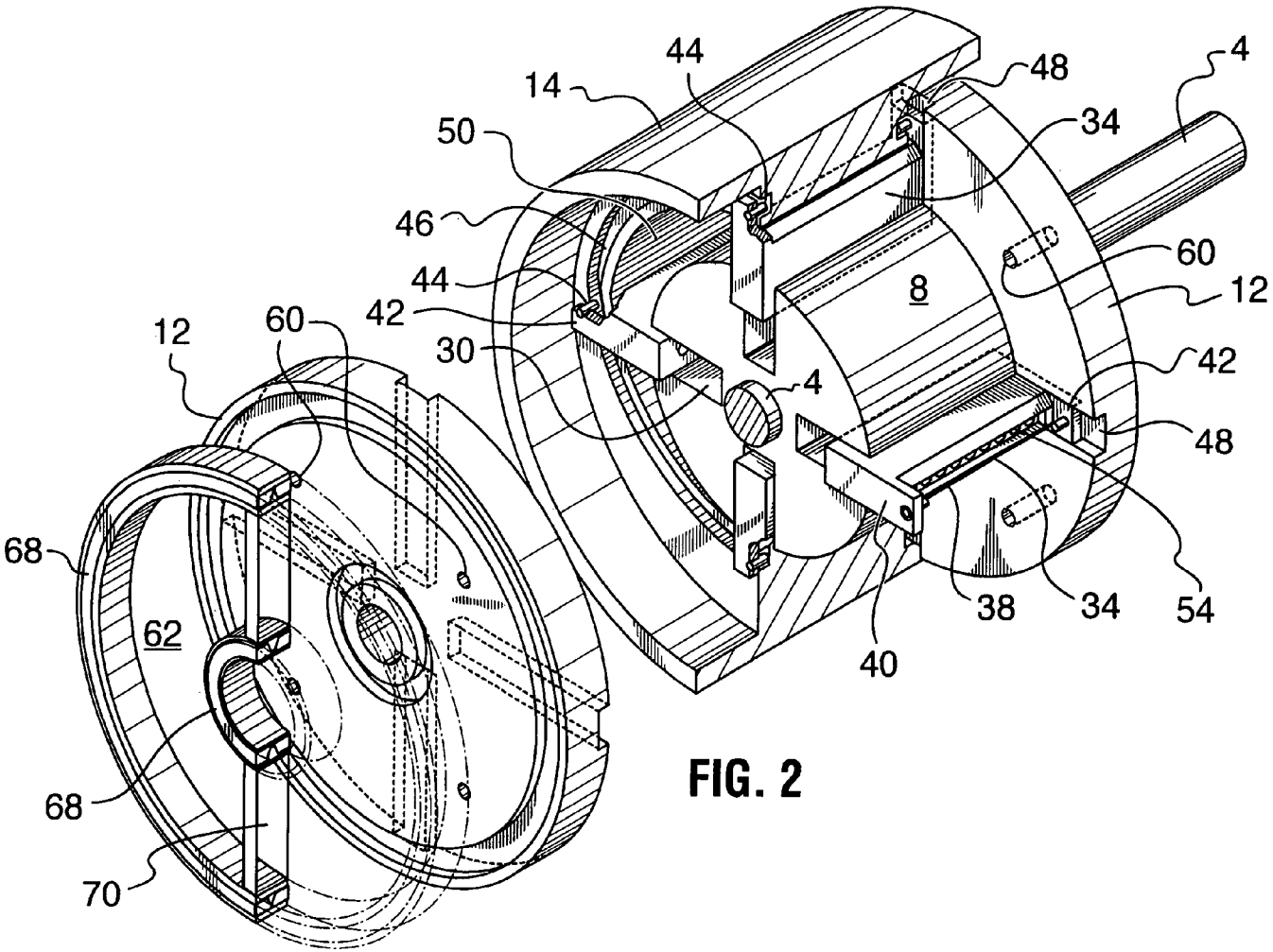
FIG. 2 is a perspective view, partially exploded and in partial section, of the rotary piston pump of FIG. 1.
Figure 3:
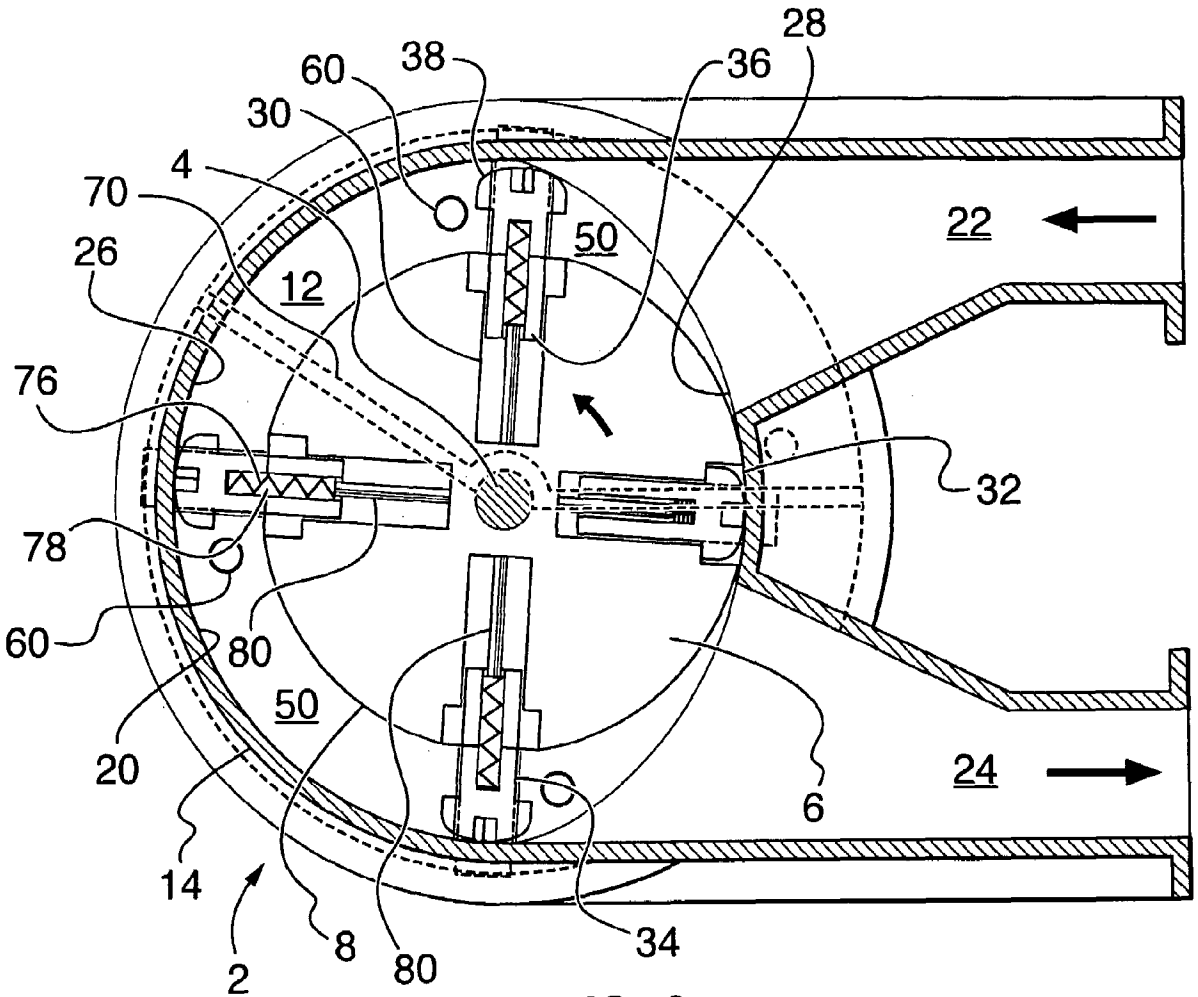
FIG. 3 is a schematic side section view of a further example embodiment of a portion of the rotary piston pump according to the present invention.
Figure 4:
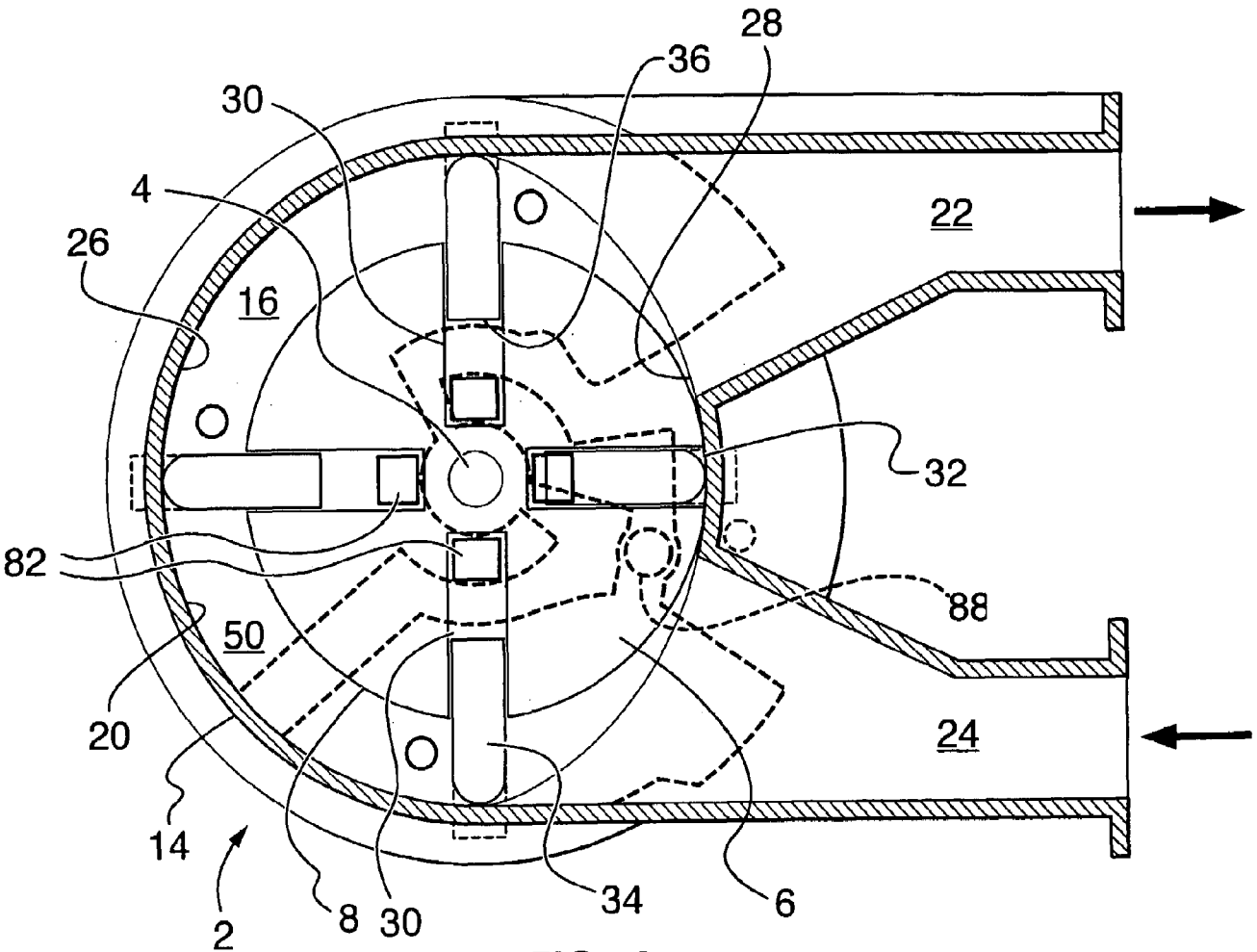
FIG. 4 is a schematic side section view of yet a further example embodiment of the rotary piston pump according to the present invention.

As can be seen in FIG. 3, first portion 26 of the interior sidewall 20 is cylindrical and curved with constant radius over an angle of about 180°. This portion is spaced a constant distance from corresponding portions of the cylindrical surface 8 of rotor 6. A second portion 28 of the interior sidewall 20 extends between the extremities of this first portion 26 of the interior sidewall. The second portion 28 has a curvature of greater radius than that of the first portion. (While FIG. 3 illustrates a different embodiment, this interior wall configuration is similar in the embodiment of FIGS. 1 and 2.)

Two or more (four are illustrated) equally spaced, radially oriented slots 30 in rotor 6 extend across its cylindrical surface 8. This cylindrical surface 8 is proximal to the interior sidewall 20 of the housing 14 at a point 32 on portion 28, about midway between the inlet and outlet ports 22 and 24. Inlet and outlet ports 22 and 24 are located in this second portion 28.

Two or more (again, four are illustrated) similar vanes 34 are slidably seated in the slots 30 of rotor 6 as illustrated. Each vane 34 has an internal edge 36 and an external edge 38 extending between sides 40 of the vanes. Each vane 34 is movable radially in its corresponding slot between an extended position with the external edge 38 of the vane adjacent first portion 26 of the interior sidewall of the housing and a retracted position when the vane reaches point 32, where that external edge 38 is retracted and does not extend beyond the cylindrical surface of the rotor. The vanes 34 are spaced from each other about the rotor such that there is always at least one vane positioned between the inlet and outlet ports 22 and 24.

In the embodiment illustrated in FIGS. 1 and 2, an ear 42 extends beyond the external edge 38 of each vane 34 at each of its sides 40. A pin 44 is secured to each ear 42 and extends inwardly, as illustrated towards the pin on the other ear 42 of that vane. That pin 44 for each ear is seated in one of a pair of oppositely facing races or grooves 46 which are formed in portions of the interior sidewall 20 of housing 14. Each race 46 is continuous and circumscribes the shaft 4 so as to provide proper extending and retracting movement of the vanes as its corresponding pins move along it during rotation of the rotor.

As can be seen in FIG. 1, a plurality of slots 48 are provided in rotor disks 12. These slots 48 are aligned with corresponding rotor slots 30 and slidably receive the sides 40 of the vanes 34 and their corresponding ears 42. Ears 42 are seated flushly in slots 48 so that their confronting surfaces are flush with and do not extend beyond the inner surface of their corresponding rotor disk 12.

The rotor 6, housing 14 and vanes 34 are constructed so that, during operation of the pump, liquid or gas entering housing 14 through inlet port 22 is carried by the rotor 6, in compartments 50 formed between adjacent vanes 34, the rotor disks 12 and rotor surface 8 between those vanes and confronting portions of the sidewall 20 and end walls 18 of housing 14, until the adjacent vanes encompass the outlet port 24 where the fluid is allowed to escape.

As can be seen in FIG. 1, it is preferred that a series of apertures 60 be provided through each rotor disk at least one such aperture being positioned in each quadrant of the rotor disk between each pair of adjacent slots 48. Each aperture 60 permits equalization of pressure between each compartment 50, and the end space 62 between the outer end 64 of rotor disk 12 and the facing portion of the end wall 18 of housing 14. A pair of annular dam seals 68, constructed as illustrated in FIGS. 1 and 2 are seated peripherally beyond these apertures 60 and on this exterior side of rotor disk 12. The transverse portion 70 of each dam seal 68 divides each end space 62 into two sub-sections. (Depending upon the application, the dam seals could be configured to divide each end space 62 into more than two sub-sections. However, there would never be more such sub-sections than the number of compartments 50.) In this way, pressure in each of the sub-sections of end space 62 is equalized with the pressure of the fluid in the corresponding compartment or compartments 50 on the other side of the respective aperture or apertures 60 extending through rotor disk 12.

In particular, the pump construction illustrated in FIGS. 1 and 2 allows the higher pressures of fluid in compartments 50 as vanes 34 pass the constant radius, first portion 26 of interior sidewall 20, up to the discharge port, and the lower pressures in compartments 50 as they pass the outlet port 24 and fluid inlet port 22, to equalize on the other side of the corresponding end disk 14, in the relevant segment of end space 62. Since dam seals 68 and portions 70 are arranged to allow part of rotor disks 12 to have high pressure matching the outlet port pressure of the fluid and the other part of the disk to have lower or zero pressure matching that of the inlet port 22, deflection of the end disks due to pressure differentials is avoided. Transverse portion 70 also restricts fluid from going from outlet port 24, through apertures 60 and end space 62, into inlet port 22, and avoids the need of reed valves in apertures 60, as was previously required in the rotary piston described and illustrated in applicant's previously mentioned application Ser. No. 10/680,236.

Turning to FIG. 3, there is illustrated an alternative embodiment of rotary piston pump according to the present invention, in which external activation of vanes 34, and ensuring those vanes are always in contact with corresponding portions of inner sidewalls 20 of housing 14, is by means of biasing from springs 76. These springs are held in pockets 78 which extend inwardly, as illustrated, from the internal edge 36 of vane 34. Two or more such springs 76 and pockets 78 may be provided, in which case they are located in spaced fashion from side to side in each vane 34. Secured to the bottom of each slot 30 in rotor 6, and positioned to be mateably received in vane pockets 78, are dowels 80. Springs 76 are held within pockets 78 by these dowels 80, and bear against the pins and the bottoms of the respective pockets so as to provide appropriate upward bias to the vanes in their corresponding rotor slots 30. During operation, the outer edge 38 of each vane 34 is constantly positioned against a corresponding portion of the interior side wall 20 of housing 14. Again the rotor 6, housing 14 and vanes 34 are constructed so that, during operation of the rotary piston, fluid entering housing 14 is carried by rotor 6 in compartments 50 formed between adjacent vanes 34, rotor cylindrical side wall 8 between those vanes, the rotor disks 12 and the corresponding portions of the interior side wall 20 of housing 14, until these adjacent vanes encompass the outlet port 24, at which point fluid in that compartment 50 is allowed to escape through outlet port 24.

In this illustrated embodiment, the transverse portions 70 of the dam seals within end space 60 have a somewhat different configuration than in the embodiment of FIGS. 1 and 2, although they still extend along a line between the fluid inlet port 22 and outlet port 24.

Figure 5:
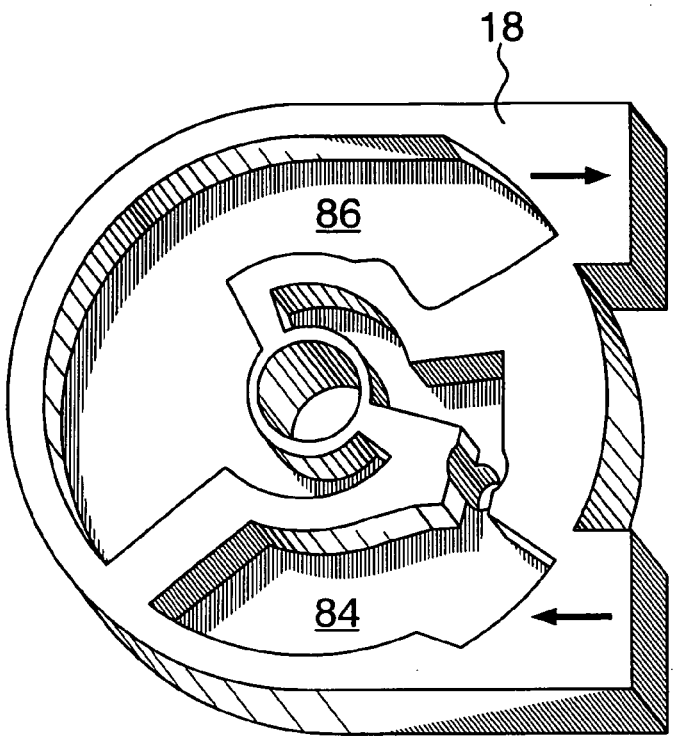
FIG. 5 is a perspective view of an end wall, from the interior, of the housing of the pump of FIG. 4.
Figure 6:
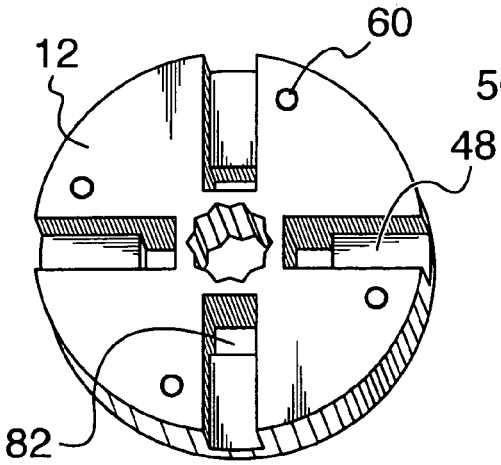
FIG. 6 is a perspective view of a rotor disk of the pump of FIG. 4.

In the embodiment illustrated in FIGS. 4 to 7, although the rotor and rotor disk construction is similar to the embodiment of FIG. 3, the spring and dowel arrangement for the vanes is optional and may not be required. As well, as can be seen in FIG. 6, holes 82 are formed at the bottom of rotor disk slots 48 as illustrated. As can be seen in phantom in FIG. 4, and more clearly in FIG. 5, a pair of mutually exclusive, configured depressions 84 and 86 are positioned on the inner surfaces of each of the end walls 18 as illustrated. Depressions 84 and 86 may be machined in the inner surfaces of end walls 18, or may be formed in a flat piece which is subsequently welded or otherwise secured to that interior surface of end wall 18.

The apertures 60 in end disks 40 are positioned so that as appropriate, they communicate with these depressions 84 and 86. Depression 84 is configured to be the low pressure depression so as to deliver, during operation of pump 2, the pressure of fluid being drawn into compartments 50 from the inlet 22 through the corresponding holes 82 below the vanes 34, as vanes 34 pass over the portion 28 of the interior sidewall 20, until the vanes reach point 32. In this manner pressure is reduced in rotor slots 30, below vanes 34 so as to assist the vanes as they are moved to retracted position over this portion of travel of the vanes. As well, this low pressure depression 84 is configured so as to communicate with apertures 60 of rotor disks 12 of compartments 50 as their corresponding vanes 34 travel from this point 32 over the rest of portion 28. In this manner, equalization of fluid pressure on either side of rotor disks 12 between compartments 50 and low pressure depression 84 is permitted.

Depression 86, being the depression for high pressure, is configured so as to permit alignment of holes 82 in the lower ends of rotor disk slots 48 so that these holes 82 will be in alignment with depression 86 when the corresponding vanes 34 and compartments 50 are traveling from point 32, past inlet port 24 and over much of the first portion 26 of the interior sidewall. Over this portion of travel, the compartments 50 are at high pressure. Accordingly, high pressure is passed through appropriately positioned apertures 60 through rotor disks 12, into high pressure depression 86, and through holes 82 into the lower portions of rotor slots 30 below the relevant vanes 34, thereby assisting in extending and maintaining those vanes 34 in their fully extended positions as they travel over first portion 26 of the interior sidewall. As well, apertures 60 ensure an equalization of high pressure, as appropriate, on opposite sides of rotor disk 12.

A pressure screw 88 (FIGS. 7 and 8) is provided in a corresponding aperture in end walls 18 of housing 14, permitting partial closure of the low pressure depression 84 as illustrated, allowing adjustment of the pressure from midrange to low within this depression. This pressure screw 88 may be in the form of a threaded bolt in from the outside of end wall 18 of housing 14. This bolt taps into low pressure depression 84 adjacent to inlet port 22, as illustrated, and allows adjustment so as to partially close off low pressure depression 84. This adjustable restriction allows high pressure in rotor slots 30, when they are aligned so as to exhaust into low pressure depressions 84, to lose pressure more slowly, resulting in a mid-pressure between the high pressure of outlet port 24 and the low or zero pressure of inlet port 22. The adjustable mid-range pressure will be of advantage in some instances so as to avoid the vanes being urged into their retracted position less aggressively and related banging of vanes into rotor slots 30.

Figure 7:
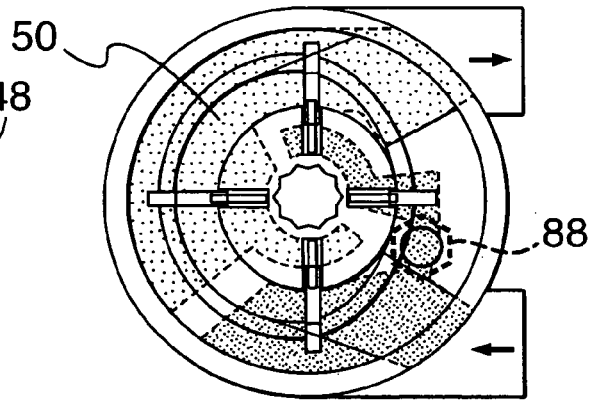
FIG. 7 is a schematic side view of the interior of the pump of FIG. 4, illustrating more clearly certain aspects of the operation of the pump.
Figure 8:
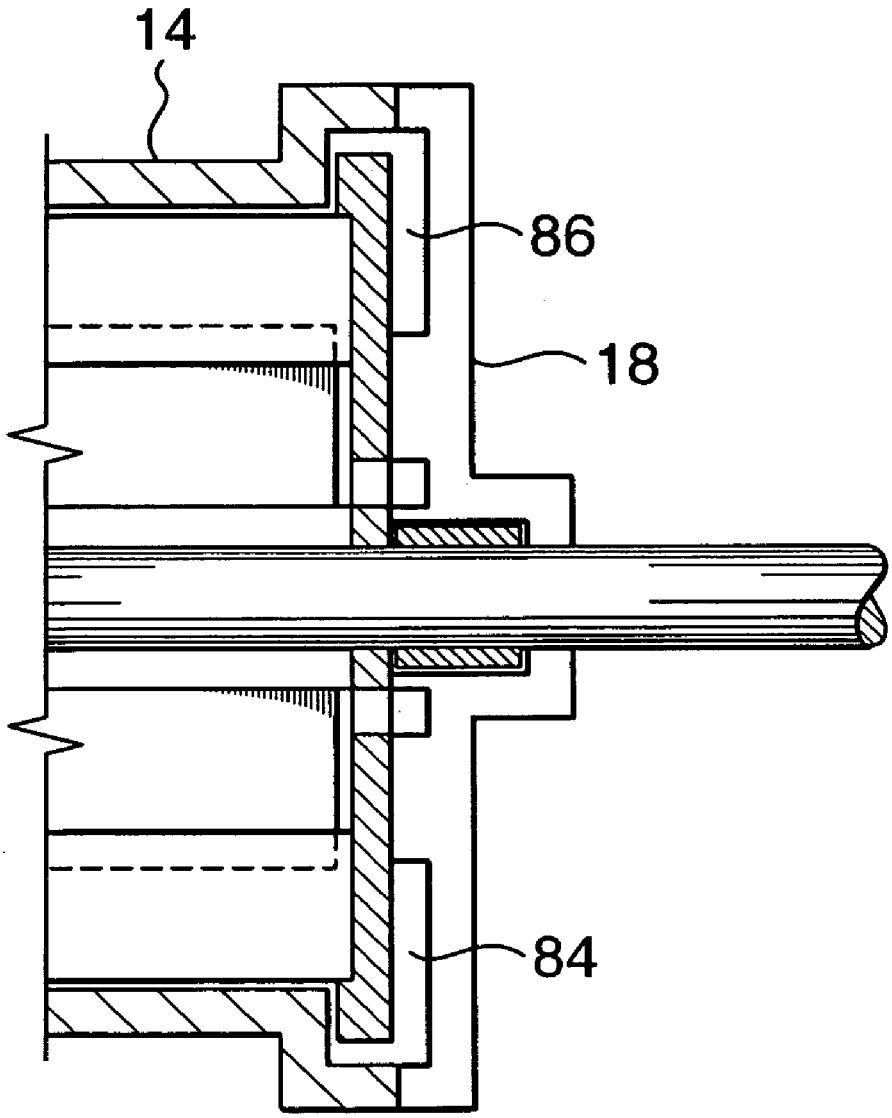
FIG. 8 is a longitudinal section view of a portion of the pump along line 8—8 of FIG. 4.

It will be understood that for a particular application, the embodiment of FIGS. 5 to 7 may be provided on one end of housing 14, and the other end provided with the dam seal 68/70 construction of FIG. 1 or 3.

Furthermore, it will be understood that the present invention has application to many different constructions of rotory piston pump besides those specifically illustrated herein, including, for example, the fluid cannon positive displacement pump described and illustrated in applicant's previously mentioned U.S. Pat. No. 6,896,502, the contents of which are incorporated herein by reference.

Thus, it is apparent that there has been provided in accordance with the invention an improved rotary piston pump end pressure regulation system that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A rotary piston pump comprising:

a shaft to rotate about a longitudinal axis;

a rotor centrally secured to the shaft, the rotor having a body with a cylindrical surface extending between spaced ends;

a rotor disk secured at each end of the rotor, each rotor disk secured at a center to the shaft;

a housing encasing the rotor and the rotor disks and portions of the shaft within an internal cavity, the housing having interior end walls adjacent to, but spaced from, the corresponding rotor disks to form an end space therebetween, and an interior sidewall, with fluid inlet and fluid outlet ports in the interior sidewall, a first portion of the interior sidewall of the housing being cylindrical and curved with a constant radius over an angle of about approximately 180°, the first portion being spaced a constant distance from confronting portions of the cylindrical surface of the rotor, and a second portion of the interior sidewall of the housing extending between the extremities of the first portion of the interior sidewall, and a curvature of the second portion having a greater radius than a curvature of the first portion, the cylindrical surface of the rotor being proximal to the interior sidewall of the housing at a point between the fluid inlet and fluid outlet ports about midway along the second portion, the fluid inlet and fluid outlet ports being located in this second portion of the interior sidewall of the housing;

two or more equally spaced, radially oriented slots in the rotor longitudinally extending across the cylindrical surface of the rotor body;

two or more similar vanes, each vane having internal and external edges extending between sides, each vane slidably seated in one of said slots, each vane movable radially in the corresponding slot between an extended position with the external edge of the vane adjacent the interior sidewall of the housing, and a retracted position wherein the external edge of the vane does not extend beyond the cylindrical surface of the rotor, the vanes being spaced from adjacent vanes about the rotor such that there is always a vane positioned between the fluid inlet and fluid outlet ports;

means associated with the vanes to enable the vanes to move to extended position;

a plurality of slots in the rotor disks aligned with the rotor slots and slidably receiving the sides of the vanes;

the rotor disks, the housing and the vanes constructed so that, during operation of the rotary piston pump, fluid entering the housing through the inlet port is carried by the rotor, in each of compartments formed between adjacent vanes, the rotor surface between the vanes, the rotor disks and the corresponding portions of the end walls and interior sidewall of the housing, until the adjacent vanes encompass the outlet port where the fluid is allowed to leave the housing, at least one aperture being provided in each compartment through each rotor disk to permit fluid communication from the compartment to the end space, thereby to permit equalization of fluid pressure in the compartment and in the end space; and the end space between each of the corresponding housing end walls and rotor disks being provided with partitioned sections extending in a line between the fluid inlet and fluid outlet ports and dividing that end space into two or more sub-sections, the partition sections constructed so as to withstand pressure differentials between the sub-sections on either side of the partition sections.

2. A pump according to claim 1, wherein the means to enable the vanes to move to extended position comprise springs urging the vanes to that position.

3. A pump according to claim 1, wherein the means to enable the vanes to move to extended position comprise upward extensions of shoulders at the sides of each vane, which upper extensions contain pins seated in races continuously extending in portions of the interior sidewall of the housing and positioned so that, as the pins move about the races, they move their respective vanes outwardly.

4. The rotary piston device according to claim 1, wherein the rotor is provided with four slots, and four vanes, one of said vanes being slidably seated within each slot of the rotor.

5. The rotary piston device according to claim 4, wherein at least one aperture through the rotor disk is provided in each quadrant between adjacent slots.

6. A rotary piston pump for fluids comprising:

a shaft to rotate about a longitudinal axis;

a rotor centrally secured to the shaft, the rotor having a body with a cylindrical surface extending between spaced ends;

a rotor disk secured at each end of the rotor, each rotor disk secured at a center to the shaft;

a housing encasing the rotor and rotor disks and portions of the shaft within an internal cavity, the housing having interior end walls adjacent to the corresponding rotor end disks, and an interior sidewall, with fluid inlet and fluid outlet ports in the interior sidewall, a first portion of the interior sidewall of the housing being cylindrical and curved with a constant radius over an angle of about approximately 180°, the first portion being spaced a constant distance from confronting portions of the cylindrical surface of the rotor, and a second portion of the interior sidewall of the housing extending from the extremities of the first portion of the interior sidewall, and a curvature of the second portion having a greater radius than a curvature of the first portion, the cylindrical surface of the rotor being proximal to the interior sidewall of the housing at a point between the fluid inlet and fluid outlet ports about midway along the second portion, the fluid inlet and fluid outlet ports being located in this second portion of the interior sidewall of the housing;

two or more equally spaced, radially oriented slots in the rotor longitudinally extending across the cylindrical surface of the rotor body;

two or more similar vanes, each vane having internal and external edges extending between sides, each vane slidably seated in one of said slots, each vane movable radially in the corresponding slot between an extended position with the external edge of the vane adjacent the interior sidewall of the housing, and a retracted position wherein the external edge of the vane does not extend beyond the cylindrical surface of the rotor, the vanes being spaced from adjacent vanes about the rotor such that there is always a vane positioned between the fluid inlet and fluid outlet ports;

a plurality of slots in the rotor disks aligned with the rotor slots and slidably receiving the sides of the vanes;

the rotor disks, the housing and the vanes constructed so that, during operation of the rotary piston pump, fluid entering the housing through the inlet port is carried by the rotor, in each of compartments formed between adjacent vanes, the rotor surface between the vanes, the rotor disks and the corresponding portions of the end walls and interior sidewall of the housing, until the adjacent vanes encompass the outlet port where the fluid is allowed to leave the housing, a pair of configured depressions positioned in each of the end walls, open towards the corresponding rotor disk, ports at the bottoms of the slots in the rotor disks passing through the rotor disks to provide fluid communication between lower portions of the rotor disk slots below the vanes and the configured depressions, and at least one aperture being provided in each compartment through each rotor disk, the apertures and configured depressions positioned to be intermittently aligned, during operation of the pump, so as to permit equalization of fluid pressure in the compartment and in the configured depressions when the apertures are in alignment with the configured depressions; and the configured depressions being configured so as to deliver, during operation of the pump, the lesser pressure of fluid being drawn into the compartments from the inlet port through the slots below the vanes as the vanes pass over part of the second portion of the interior sidewall adjacent to the outlet port so as to urge those vanes inwardly towards retracted position, and to deliver the greater pressure of the fluid being carried in the compartments between the inlet and outlet ports through the slots below the vanes when the vanes approach the inlet port and pass over the constant radius portion of the sidewall so as to urge those vanes outwardly towards extended position.

7. A pump in accordance with claim 6 further provided with springs urging the vanes to extended position.

8. A pump in accordance with claim 6 provided with four slots in the rotor disk and four vanes.

* * * * *